US005126551A

United States Patent [19]

L'Hermite

[11] Patent Number: 5,126,551

[45] Date of Patent: Jun. 30, 1992

[54] PHOTOMULTIPLIER TUBE COMPRISING A MULTIPLIER WITH STACKED DYNODES INSIDE A TRUNCATED CONE

[75] Inventor: Pierre L'Hermite, Brive La Gaillarde, France

[73] Assignee: U.S. Philips Corporation, New York, N.Y.

[21] Appl. No.: 603,972

[22] Filed: Oct. 23, 1990

[30] Foreign Application Priority Data

Oct. 27, 1989 [FR] France ..... 89 14143

[51] Int. Cl.[5] ..... H01J 40/14

[52] U.S. Cl. ..... 250/207; 313/533

[58] Field of Search ..... 250/207, 213 VT, 211 R; 313/532, 533, 534, 535, 536, 550

[56] References Cited

U.S. PATENT DOCUMENTS

| | | | |
|---|---|---|---|
| 3,668,388 | 6/1972 | Fisher et al. | 313/531 |
| 4,333,031 | 6/1982 | Butterwick | 313/550 |
| 4,687,921 | 8/1987 | Kojola | 250/207 |
| 4,937,506 | 6/1990 | Kimura et al. | 250/207 |

*Primary Examiner*—David C. Nelms
*Assistant Examiner*—Que T. Le
*Attorney, Agent, or Firm*—Robert J. Kraus

[57] ABSTRACT

A photomultiplier tube comprises a photocathode (10) deposited on an input window (20) sealed to one end of a sleeve (30), an input electrode (40), and an electron multiplier (50) with stacked dynodes. The input electrode (40) is constituted by a truncated cone conductor on the inside of which the electron multiplier (50) with stacked dynodes is deposited. A generator (61,62) of a material forming the photocathode (10) is advantageously placed in the space (70) situated between the input electrode (40) and the sleeve (30).

3 Claims, 1 Drawing Sheet

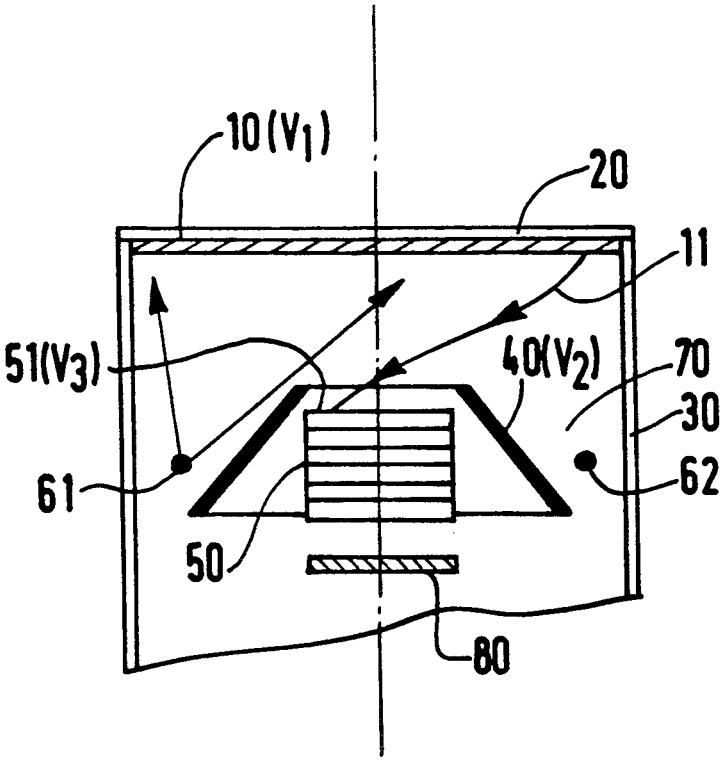
10(V1)
20
11
51(V3)
40(V2)
70
30
61
62
50
80

PHOTOMULTIPLIER TUBE COMPRISING A MULTIPLIER WITH STACKED DYNODES INSIDE A TRUNCATED CONE

BACKGROUND OF THE INVENTION

The present invention relates to a photomultiplier tube comprising a photocathode, an input electrode and an electron multiplier with stacked dynodes.

The invention may be applied particularly advantageously in the field of photomultiplier tubes having electron multipliers with stacked dynodes. "Electron multipliers with stacked dynodes" is to be understood to mean all the multiplier devices having a laminated structure, for example, the multipliers of the "sheet" type (see, for example, French Pat. Specification No. 2,549,288) or also the multipliers having shutter dynodes in which each dynode is constituted by parallel slats inclined with respect to the axis of the multiplier.

A general technical problem which presents itself in any photomultiplier tube is to ensure a collection of photoelectrons issued from the photocathode which is as large as possible. In the case of the tubes comprising a multiplier device with stacked dynodes, this general technical problem is coupled with another problem, namely that of coupling the first dynode to the multiplier device in such a manner that the secondary electrons emitted by the photocathode can reach the multiplier device with stacked dynodes with low losses.

A solution to this double technical problem is given, for example, in French Pat. Specification No. 2,549,288 (FIG. 12) which describes a photomultiplier tube as mentioned in the opening paragraph and the first dynode of which is cylindrical, having generatrices orthogonal to the axis of the tube. In the said known tube the coupling between the first dynode and the electron multiplier device with stacked dynodes of the "sheet" type is realised by placing the multiplier at the output of the first dynode, the axis of the "sheet" multiplier being provided perpendicularly to the axis of the tube. So in this configuration the multiplier device offers the greatest possible collecting section for secondary electrons emitted by the first dynode, hence a good collection efficiency.

However, the photomultiplier tube known from the prior art has the disadvantage of a comparatively large lateral space due mainly to the fact that, taking into account the rather important dimensions of the first dynode and the dispersion of the secondary electrons emitted by the latter, the "sheet" multiplier may not be placed in the immediate proximity of the first dynode. Moreover, an exit is needed towards the rear of the multiplier for the output connections, which contributes to augmenting the dimensions of the sleeve serving as envelope of the tube.

Moreover, the known tube also has the disadvantage of a considerable longitudinal space, connected with the necessity of having to provide at a sufficient distance between the photocathode and the first dynode, to permit the focussing input electrode to ensure its function of concentrating the photoelectrons on the first dynode.

SUMMARY OF THE INVENTION

A technical problem to be solved by the object of the present invention is also to propose a photomultiplier tube comprising a photocathode deposited on an input window sealed to one end of a sleeve, an input electrode, and an electron multiplier with stacked dynodes, due to which tube a very high collection efficiency could be obtained, that is to say, a perfect coupling between the photocathode and the electron multiplier with stacked dynodes, while presenting a reduced lateral and longitudinal space.

According to the present invention the solution to the technical problem mentioned hereinbefore consists in that the input electrode comprises a truncated cone conductor on the inside of which the electron multiplier with stacked dynodes is provided.

Hence, on the one hand, since: the electron multiplier with stacked dynodes occupies a central position in the tube, the lateral space is substantially reduced. On the other hand, as will be described in detail hereinafter, while applying an electric potential near that of the photocathode to the input electrode, the ideal situation is reached of a coupling between the photocathode and the multiplier and hence a perfect collection efficiency, since, in the space situated between the photocathode and the assembly of input electrode - multiplier, the accelerating electric field of the photoelectrons originates essentially from the first dynode of the multiplier with stacked dynodes. Insofar as the electrons produced by the photocathode inevitably reach the multiplier, it may be contemplated to bring the multiplier nearer to the photocathode, hence a reduction of the longitudinal space of the tube.

According to a preferred embodiment the photomultiplier tube according to the invention is moreover characterised in that it comprises at least one generator of a material forming the photocathode placed in the space situated between the input electrode and the sleeve. The generator of a material forming the photocathode is maintained comparatively far away from the photocathode while using the space left free between the input electrode and the sleeve due to the shape of the truncated cone given to the input electrode. This arrangement permits of obtaining very homogeneous photocathodes despite the reduction in length of the tube.

BRIEF DESCRIPTION OF THE DRAWING

The invention will now be described in greater detail with reference to the accompanying drawing given by way of non-limiting example.

The sole figure is a cross-sectional view of a photomultiplier tube according to the invention.

DESCRIPTION OF THE PREFERRED EMBODIMENT

The cross-sectional view of FIG. 1 shows a photomultiplier tube comprising a photocathode 10, for example, of alkaline antimonide, deposited on an input window 20 sealed to one end of a cylindrical sleeve 30. Under the effect of an incident light radiation the photocathode emits photoelectrons 11 which must reach, for secondary multiplication, an electron multiplier 50 with stacked dynodes, the multiplication axis of which substantially coincides with the axis of the cylindrical sleeve 30. An example of an electron multiplier with stacked dynodes which could be suitable for the present invention is described in French Pat. Application No. FR-A-2 549 288. An anode 80 placed at the output of the multiplier 50 collects the electrons resulting from the multiplication by the stacked dynodes.

As shown in FIG. 1, the photomultiplier tube also comprises an input electrode 40 constituted by a truncated cone conductor on the inside of which the electron multiplier 50 is provided. During operation the photocathode is brought to the potential $V_1$, which is taken to be equal to 0 V, first dynode 51 of the multiplier 50 is at a potential $V_3$ of approximately 300 V, while the input electrode 40 has a potential $V_2$ of 0 to 25 V, and generally, less than 10% of the potential $V_3$. In a general manner, according to the invention, the cathode 10 is at a potential $V_1$, the potential $V_2$ of the input electrode 40 is between $V_1$ and $V_1$ augmented by 10% of the difference between the potential $V_3$ of the first dynode 51 of the multiplier 50 and the potential $V_1$ of the photocathode 10. If the input electrode is at $V_2 = V1$, all the electrons 11 emitted by the photocathode 10 are captured by the first stackable dynode 51, since in the input space of the tube the electric field is produced 35 exclusively by the first dynode 51 at potential $V_3$. The coupling and the collection are good no matter what is the value of V3 and the distance between the photocathode 10 and the multiplier 50. So the multiplier 50 of the photocathode may be brought nearer to the photocathode 10 without detrimentally affecting the collection, hence a shorter tube. Likewise, section of the tube may be reduced due to the fact that the coupling is independent of the incidence of the electrons. Consequently, the effective input surface may be limited to the surface - which is small as it is of - the stacked dynodes.

It may hence be observed that, with the potentials $V_1$ and $V_2$ equal, the temporal response of the tube is not very good, for the transit time of the photoelectrons may vary notably between the electrons from the centre of the photocathode 11 and those coming from the edges. In order to remove this disadvantage it is endeavoured to bring the input electrode 40 to a potential $V_2$ of, for example, 25 V, (VI being supposed to be equal to 0 Volt), which ameliorates the response time of the tube without deteriorating the collection efficiency substantially.

It is possible to realise, at least partially, the photocathode with the aid of generators of material constituting the photocathode. Actually, the generators, notably antimony grains, should be placed opposite to the photocathode and comparatively far away from the same to obtain a homogeneous photocathode. As shown in FIG. 1, it is possible to fulfill this requirement while maintaining the electron multiplier 50 in the proximity of the photocathode 10 by placing the generators 61, 62 in the space 70 situated between the input electrode 40 and the sleeve 30. As indicated by the arrows proceeding from the generator 61, the antimony produced by the generators 61 and 62 may cover the photocathode 10 in a homogeneous manner.

I claim:

1. A photomultiplier tube comprising a photocathode (10) deposited on an input window (20) sealed to one end of a sleeve (30), an input electrode (40), and an electron multiplier (50) with stacked dynodes, characterized in that said input electrode (40) comprises a truncated cone conductor on the inside of which the electron multiplier (50) with stacked dynodes is disposed, said input electrode cooperating with the photocathode and the electron multiplier to effect collection by a first one of the dynodes of photoelectrons emitted by the photocathode.

2. A photomultiplier tube as claimed in claim 1, characterised in that the photomultiplier tube comprises at least one generator (61, 62) of a material from which the photocathode is formed placed in the space (70) situated between the input electrode (40) and the sleeve (30).

3. A photomultiplier tube as in claim 1, said tube effecting efficient collection by the first dynode of photoelectrons emitted by the photocathode when the photocathode is brought to a potential $V_1$, the first dynode is brought to a potential $V_3$ which is substantially higher than $V_1$, and the input electrode is brought to a potential $V_2$ which is between $V_1$ and $V_1 + 10\% (V_3 - V_1)$.

* * * * *